US005799737A

United States Patent [19]

Kamikawa et al.

[11] Patent Number: 5,799,737

[45] Date of Patent: *Sep. 1, 1998

[54] BLADE APPARATUS AND ITS CONTROL METHOD IN BULLDOZER

[75] Inventors: Nobuhisa Kamikawa; Naomi Kobayashi, both of Hirakata; Noriaki Namiki, Kyoto; Norihisa Matsumoto, Hirakata, all of Japan

[73] Assignee: Komatsu Ltd., Tokyo, Japan

[ * ] Notice: The term of this patent shall not extend beyond the expiration date of Pat. No. 5,620,053.

[21] Appl. No.: 777,619

[22] Filed: Dec. 31, 1996

Related U.S. Application Data

[62] Division of Ser. No. 378,839, Jan. 26, 1995, Pat. No. 5,620,053.

[30] Foreign Application Priority Data

Jan. 28, 1994 [JP] Japan ..... 6-26136

[51] Int. Cl.[6] ..... E02F 3/76

[52] U.S. Cl. ..... 172/2; 172/821; 172/826

[58] Field of Search ..... 172/2, 4.5, 811, 172/812, 813, 815, 819, 821, 822, 824, 826; 414/273, 274

[56] References Cited

U.S. PATENT DOCUMENTS

| | | | |
|---|---|---|---|
| 3,503,457 | 3/1970 | Smith et al. | 172/826 |
| 3,774,696 | 11/1973 | Horsch | 172/804 |
| 3,823,783 | 7/1974 | Luedtke | 172/821 X |
| 4,086,843 | 5/1978 | Lorimor | 91/413 |
| 4,201,268 | 5/1980 | Frisbee | 172/804 |
| 4,562,891 | 1/1986 | Ranner | 172/821 |
| 4,664,203 | 5/1987 | Williams | 172/826 |
| 4,848,483 | 7/1989 | Heiple | 172/821 |
| 5,010,961 | 4/1991 | Frisbee | 172/821 |
| 5,462,125 | 10/1995 | Stratton et al. | 172/826 |
| 5,467,829 | 11/1995 | Barton et al. | 172/4.5 |
| 5,473,541 | 12/1995 | Ishino et al. | 364/424.07 |
| 5,620,053 | 4/1997 | Kamikawa et al. | 172/821 X |

FOREIGN PATENT DOCUMENTS 3-50646 5/1991 Japan .

OTHER PUBLICATIONS

Akio Terai, Herb Aoki, and R.H. Stanage, "New Design concept for Komatsu D455A Bulldozer and the Actual Results", SAE Paper No. 790902, (no date).

*Primary Examiner*—Terry Lee Melius
*Assistant Examiner*—Robert Pezzuto
*Attorney, Agent, or Firm*—Sidley & Austin

[57] ABSTRACT

A hydraulic drive system for the pitch cylinders (4A, 4B) of a bulldozer blade apparatus can include (a) main hydraulic pumps (30A, 30B) and an assistant hydraulic pump (31) to make up the assistant hydraulic circuit, (b) variable displacement hydraulic pumps (21A, 21B), or (c) fixed displacement hydraulic pumps (30A, 30B) and a plurality of solenoid selector valves such that the pitch cylinders can be connected in series. The assistant hydraulic pump (31) is connectable to delivery lines of the main hydraulic pumps through an assistant solenoid selector valve (32) which is controlled by an external signal. The blade (10) can be formed so that a line (14) tangential to the lower edge of the curved panel of the blade is inclined rearwardly with respect to the front face (13) of the blade edge member (12). Earth-moving work can be performed by inclining the blade (10) rearwardly by an angle ($\theta_1$) with respect to its posture in digging work, and earth-dumping work can be performed by inclining the blade (10) forwardly by an angle ($\theta_2$) with respect to its posture in digging work. The coupling positions of the two pitch cylinders (4A4B) can be in asymmetrical relation to each other. Control signals can be provided by a blade lever (23), tilt/pitch changeover switch (24), and pitch speed changeover switch (25). The tilt/pitch changeover switch (24) and pitch speed changeover switch (25) can be replaced by pitch-dump selector switch (25A) and pitch-back selector switch (24A).

19 Claims, 11 Drawing Sheets

α3 = 73°
β3 = 63°

BLADE APPARATUS AND ITS CONTROL METHOD IN BULLDOZER

RELATED APPLICATION

This is a division of application Ser. No. 08/378,839, filed Jan. 26, 1995, now U.S. Pat. No. 5,620,053, issued on Apr. 15, 1997.

TECHNICAL FIELD OF THE INVENTION

The present invention relates to a blade apparatus and its control method in a bulldozer. More particularly, the invention relates to a blade apparatus and its control method in a bulldozer such that the blade can be operated in lift, tilt and pitch modes.

BACKGROUND ART

FIG. 15 is a left side view of a prior art bulldozer 1 equipped with a blade (earth-moving plate) 50. The bulldozer 1 has a pair of elongated frame members 3, each of which has one end pivotally mounted on a respective lateral side of a body 2. The blade 50 is pivotally mounted to the distal ends of the frame members 3 such that it can swing in the longitudinal direction of the bulldozer 1. The blade 50 is also pivotally coupled at its transverse opposite ends to intermediate portions of the frame members 3 by respective pitch hydraulic cylinders 4A (shown on the left side of the body 2) and 4B (located on the right side of the body 2), and is also pivotally coupled to the body 2 by a lift hydraulic cylinder 5. A front panel 51 of the blade 50 is formed so as to have a curved or concave surface in a vertical plane, and a blade edge member 52 is fitted to a lower end of the front panel 51 while extending substantially tangential to the curved surface of the front panel 51. By operating the lift hydraulic cylinder 5 to extend or contract, the blade 50 is raised or lowered as indicated by the arrow A. Also, by operating both of the pitch hydraulic cylinders 4A and 4B to simultaneously extend or to simultaneously contract, the blade 50 is pitched in the longitudinal direction as indicated by the arrow B. Further, by operating only one of the pitch hydraulic cylinders 4A, 4B to extend or contract, or operating one to extend and the other to contract, the blade 50 can be tilted to the right or to the left, as indicated by the two broken rectangles in FIG. 16.

In another prior art bulldozer as proposed in Japanese Utility Model Laid-Open No. 3-50646, for example, a blade is operated in the lift, tilt and pitch modes by one control lever and by one operation changeover switch between the tilt and pitch modes. While an edge angle $\alpha$ (the angle between the front face of the blade edge member and a horizontal line as shown in FIG. 15) of the blade, formed when the blade is placed on the ground, is suitably about 55° for the nature of ground and work conditions in the usual case, it can be adjusted to the extent of ±5°, depending on differences in the nature of ground and work conditions.

On the other hand, looking at the balance of forces when a bulldozer is performing earth-moving work, as illustrated in FIG. 17, the traction force $F_2$ must be greater than the earth-moving resistance $F_1$ and the vehicle's driving force $F_3$ must be greater than the traction force $F_2$. Specifically, assuming that the weight of earth 6 being moved by the blade is G, the friction coefficient of the moving earth 6 with respect to the ground surface is $\mu_1$, the weight of the bulldozer 1 is W, the friction coefficient of the bulldozer 1 with respect to the ground surface is $\mu_2$, the engine torque is $T_0$, the speed reducing ratio is $\rho$, and the radius of a driving wheel is R, the relationship of $$F_1=G\times\mu_1<F_2=W\times\mu_2<F_3=T_0\times\rho/R$$

is required to be satisfied.

In the past, therefore, the amount of work performed by the bulldozer has been increased by scaling up the size of the bulldozer, increasing the engine output, and enlarging the capacity of the blade. When it is desired to double the amount of earthwork, for example, this is achieved by manufacturing a bulldozer in which the engine output is substantially doubled and the vehicle weight is also substantially doubled. Thus, a series of bulldozers with different capabilities has been manufactured in accordance with the above concept. Further, the capacity of a hydraulic pump for driving working equipment in the prior art bulldozer is usually set to correspond to the capacity required for the lift hydraulic cylinder which is used to raise or lower the blade.

However, in any attempt to manufacture a bulldozer capable of effecting twice the amount of earthwork that is achievable by the largest bulldozer in the same series, technical problems, such as relating to vehicle weight and materials, must be solved in order that the stresses exerted on the frame members and other parts of the body and the life of the driving apparatus can be kept within allowable values. In solving the above technical problems, the production cost of the bulldozer is increased at a rate greater than linearly proportional with respect to the amount of earthwork. Akio Terai, Herb Aoki, and R. H. Stanage, of Komatsu America Corp., presented a report in SAE Paper No. 790902 on those technical problems. Stated otherwise, although there is a demand for bulldozers capable of moving a great amount of earth, such demand has not been met because of technical and economic difficulties.

SUMMARY OF THE INVENTION

In view of the above-mentioned problems in the prior art, an object of the present invention is to provide a blade apparatus and its control method in a bulldozer, with which the amount of earth being moved can be remarkably increased in a technically and economically practicable manner without remarkably increasing the engine output and the vehicle weight.

In a first embodiment of the blade apparatus in a bulldozer according to the present invention, hydraulic cylinders are able to control the blade for earth-moving work at a rearwardly inclined angle $\theta_1$ of the blade in the range of about 5° to about 20° with respect to the posture of the blade in digging work. A hydraulic drive system for these hydraulic cylinders comprises a hydraulic pump for supplying a hydraulic fluid to the hydraulic cylinders, directional control valves for controlling the supply of the hydraulic fluid, and changeover control means for changing over between a tilt mode and a pitch mode. For earth-dumping work, the hydraulic cylinders can control the blade at a forwardly inclined angle $\theta_2$ of the blade in the range of about 50° to about 45° with respect to the posture of the blade in digging work. Alternatively, the hydraulic cylinders can control the blade for earth-moving work at a rearwardly inclined angle $\theta_1$ of the blade in the range of about 5° to about 20° with respect to the posture of the blade in digging work and to control the blade for earth-dumping work at a forwardly inclined angle $\theta_2$ of the blade in the range of about 5° to about 45° with respect to the posture of the blade in digging work.

In the first embodiment, the blade apparatus can be arranged such that the hydraulic pump comprises the combination of a main hydraulic pump and an assistant hydraulic pump, the changeover control means includes at least an assistant solenoid selector valve, the assistant hydraulic pump is connectable to a delivery line of the main hydraulic pump through the assistant solenoid selector valve, and the assistant solenoid selector valve makes up an assistant hydraulic circuit which is controlled by an external signal. When the main hydraulic pump and the assistant hydraulic pump are provided as the hydraulic pump of the hydraulic drive system, the assistant solenoid selector valve selectively controls communication and disconnection between the delivery circuits of the main hydraulic pump and the assistant hydraulic pump. Under such control, the hydraulic cylinders are operated by the hydraulic fluid delivered from only the main hydraulic pump in the ordinary tilt and lift modes, for example, which results in a smaller power loss. On the other hand, in a pitch mode, which requires the blade to be pitched at a high speed, the assistant solenoid selector valve is controlled by an external signal so that the delivery circuits of both of the hydraulic pumps are joined with each other to increase the delivery rates of the hydraulic fluids supplied to the hydraulic cylinders. This increase in the delivery rates of hydraulic fluids enables the pitch adjusting time to be shortened, even with a large pitch-dump or pitch-back angle of the blade. The joining of both of the hydraulic delivery circuits can be effected as needed, e.g., only in a pitch-dump mode.

In another version of the first embodiment, the hydraulic pump can be a variable displacement hydraulic pump which is controlled by an external signal. When the variable displacement hydraulic pump is provided as the hydraulic pump, a delivery rate of the variable displacement hydraulic pump can be controlled by an external signal. Therefore, the power loss can be reduced and the pitch adjusting time can be shortened, as with the above case which includes the assistant hydraulic pump.

In another version of the first embodiment, the blade apparatus can be arranged such that the hydraulic pump is a fixed displacement hydraulic pump, the hydraulic cylinders comprise a first hydraulic cylinder and a second hydraulic cylinder, the changeover control means includes a plurality of solenoid selector valves, a delivery line of the fixed displacement hydraulic pump is connectable to a bottom-side line of the first hydraulic cylinder, a head-side line of the first hydraulic cylinder is connectable to a bottom-side line of the second hydraulic cylinder through one of the solenoid selector valves, and a head-side line of the second hydraulic cylinder is connectable to a drain line through another one of the solenoid selector valves, thereby making up a series hydraulic circuit. When the series hydraulic circuit is made up, the first hydraulic cylinder circuit and the second hydraulic cylinder circuit are separated from each other in the ordinary tilt and lift modes so that the hydraulic fluid from the hydraulic pump separately flows into the respective hydraulic cylinders. On the other hand, in a pitch mode, which requires the blade to be pitched at a high speed, the external signal is turned ON to control the solenoid selector valve so that all of the hydraulic fluid from the hydraulic pump flows into the bottom chamber of the first hydraulic cylinder through directional control valves and the solenoid selector valve. Then, the hydraulic fluid in the head chamber of the first hydraulic cylinder is caused to flow into the bottom chamber of the second hydraulic cylinder through the solenoid selector valve, and the hydraulic fluid in the head chamber of the second hydraulic cylinder is drained to a drain circuit through the solenoid selector valve and the directional control valves. As a result of the series hydraulic circuit thus established, the pitch adjusting time can be shortened, even with a large pitch-dump or pitch-back angle of the blade. Additionally, the second hydraulic cylinder can be smaller than the first hydraulic cylinder. In this case, the flow rate of the hydraulic fluid introduced to the second hydraulic cylinder when the two hydraulic cylinder circuits are separately formed is set to be less than that introduced to the first hydraulic cylinder.

In a second embodiment of the blade apparatus in a bulldozer according to the present invention, a blade control means, a tilt/pitch changeover means, and a pitch speed changeover means are provided, and the blade is operated in accordance with external signals outputted from these three means. The tilt/pitch changeover means and the pitch speed changeover means can be replaced by a pitch-dump selector means and a pitch-back selector means. Further, the blade apparatus can be arranged such that the hydraulic cylinders are able to control the blade at a rearwardly inclined angle $\theta_1$ of the blade in the range of about 5° about 20° with respect to the posture of the blade in digging work, and to control the blade at a forwardly inclined angle $\theta_2$ of the blade in the range of about 5° to about 45° with respect to the posture of the blade in digging work, and the hydraulic drive system can be constructed as follows. Specifically, the hydraulic drive system can be any of (a) the system using the main hydraulic pump and the assistant hydraulic pump, to make up the assistant hydraulic circuit, (b) the system using the variable displacement hydraulic pump, and (c) the system making up the series hydraulic circuit, these systems being disclosed above in connection with the first embodiment. Of the above features, in any case where the tilt/pitch changeover means and the pitch speed changeover means are used, or where the pitch-dump selector means and the pitch-back selector means are used, it is possible to selectively set the desired one of digging posture, earth-moving posture, and earth-dumping posture, and to easily perform any work of digging, earth-moving and earth-dumping.

In a third embodiment of the blade apparatus in a bulldozer according to the present invention, a line tangential to a concave front panel of the blade at its lower end is inclined rearwardly with respect to a front surface of a blade edge member which is attached to the lower end of the front panel. This rearwardly inclined angle $\gamma$ can be set to an optimum value which is less than or equal to 15°. With this feature, the amount of earth loaded on the blade can be increased, since the front surface of the blade can be inclined rearwardly to a larger extent than the pitch-back angle $\theta_1$ during the earth-moving work. In addition, when the dug earth is moved along the front panel, the concave shape of the blade panel aids in preventing the earth from being closely pressed against the front panel surface. As a result, the earth is easily dumped in earth-dumping work, and the earth-dumping efficiency is improved.

This feature of the blade apparatus according to the third embodiment can be added to the features of the blade apparatus according to either of the first and second embodiments. In this case, it is also possible to increase the amount of earth loaded on the blade and to improve the earth-dumping efficiency.

In a fourth embodiment of the blade apparatus in a bulldozer according to the present invention, the hydraulic drive system for the hydraulic cylinders includes a solenoid selector valve and a hydraulic pump comprising a main hydraulic pump and an assistant hydraulic pump, wherein the assistant hydraulic pump is connectable to a delivery line of the main hydraulic pump through the solenoid selector valve, and the solenoid selector valve makes up an assistant hydraulic circuit controlled by an external signal. With this feature, the power loss can be reduced and the pitch adjusting time can be shortened, since the delivery rate of the hydraulic fluid can be controlled as needed.

In a fifth embodiment of the blade apparatus in a bulldozer according to the present invention, the hydraulic cylinders comprises a first hydraulic cylinder and a second hydraulic cylinder, and the coupled positions of the first hydraulic cylinder and the coupled positions of the second hydraulic cylinder are in asymmetrical relation. The first hydraulic cylinder and the second hydraulic cylinder can be the same in axial length, or can be different from each other in minimum axial length and/or stroke. With this feature, the blade can be tilted by further contracting one of the hydraulic cylinders after the other hydraulic cylinder has reached its minimum stroke position, since the two hydraulic cylinders have different minimum stroke positions in the pitch-back mode of the blade. Accordingly, the tilt operation of the blade can be achieved in the earth-moving posture.

In a first embodiment of the blade control method in a bulldozer according to the present invention, the earth-moving work is performed by inclining the blade rearwardly by a predetermined angle $\theta_1$ with respect to the posture of the blade in the digging work, thereby increasing the amount of earth being moved. The predetermined rearwardly inclined angle $\theta_1$ can be less than or equal to 20°.

In a second embodiment of the blade control method in a bulldozer according to the present invention, the earth-dumping work is performed by inclining the blade forwardly by a predetermined angle $\theta_2$ with respect to the posture of the blade in the digging work, thereby enabling earth to be easily dumped from the blade. The predetermined forwardly inclined angle $\theta_2$ is less than or equal to 45°.

In a third embodiment of the blade control method in a bulldozer according to the present invention, the earth-moving work is performed by inclining the blade rearwardly by a predetermined angle $\theta_1$ with respect to the posture of the blade in the digging work, thereby increasing the amount of earth being moved, and the earth-dumping work is performed by inclining the blade forwardly by a predetermined angle $\theta_2$ with respect to the posture of the blade in the digging work, thereby enabling the earth to be easily dumped from the blade. The predetermined rearwardly inclined angle $\theta_1$ in the earth-moving work can be less than or equal to 20°, and the predetermined forwardly inclined angle $\theta_2$ in the earth-dumping work can be less than or equal to 45°.

As to the blade control methods of the first to third embodiments, the third blade control method which is a combination of the first and second methods will be described below as a representative example. Since the blade is inclined rearwardly during the earth-moving work, the amount of earth loaded on the blade and a force act on the blade in such a manner as to cause the blade to bite into the ground. Therefore, the earth-moving work is performed while the operator controls lifting of the blade, thereby producing a force that acts on the bulldozer body to press the front portion of the bulldozer body against the ground. As a result of this pressing force, the ground contact pressure of the crawler belts of the bulldozer is distributed substantially uniformly to increase the apparent body weight, and hence the traction force is increased. Further, since the amount of earth heaped up in front of the blade edge member is reduced corresponding to an increase in the amount of earth loaded on the blade and the ground contact length of the earth heaped up in front of the blade edge member is reduced, the earth pushing resistance is diminished. Accordingly, a large amount of earth can be moved by using a bulldozer having a body weight which is relatively light as compared with the prior art bulldozer. In addition, since the blade can be inclined forwardly to a larger extent than in the prior art during the earth-dumping work, the earth-dumping efficiency is improved. The forwardly inclined angle $\theta_2$ of the blade in this case is set in consideration of a rest angle of the dug earth such that the earth can be dumped from the blade even on an ascending slope where the bulldozer can perform the digging work.

In a fourth embodiment of the blade control method in a bulldozer according to the present invention, the earth-moving work is performed by inclining the blade rearwardly such that an edge angle $\alpha$ of the blade is at least 35°, thereby increasing the amount of earth moved.

In a fifth embodiment of the blade control method in a bulldozer according to the present invention, the earth-dumping work is performed by inclining the blade forwardly such that the edge angle $\alpha$ of the blade is less than or equal to 100°, thereby enabling the earth to be easily dumped.

In a sixth embodiment of the blade control method in a bulldozer according to the present invention, the earth-moving work is performed by inclining the blade rearwardly such that the edge angle $\alpha$ of the blade is at least 35°, thereby increasing the amount of earth moved, and the earth-dumping work is performed by inclining the blade forwardly such that the edge angle a of the blade is less than or equal to 100°, thereby enabling the earth to be easily dumped.

With the blade control methods of the fourth to sixth embodiments, in the earth-moving work, the blade edge angle $\alpha$ is small to reduce the resistance exerted on the blade edge member from the earth, and the amount of earth held by the blade is enlarged to increase the amount of earth being moved by the blade. In the earth-dumping work, the blade edge member is inclined forwardly to make the earth drop smoothly from the blade, enabling the earth to be easily dumped from the blade.

In the blade control method in a bulldozer according to the above third or sixth embodiment, the method can be modified such that tilt/pitch changeover means for controlling the blade to be inclined forwardly or rearwardly, pitch speed changeover means, and control means for raising and lowering the blade are provided, and any of a posture for the digging work, a posture for the earth-moving work, and a posture for the earth-dumping work is selected by the combined operation of the tilt/pitch changeover means, the pitch speed changeover means, and the control means for raising and lowering the blade. The tilt/pitch changeover means and the pitch speed changeover means can be replaced by a pitch-dump selector means and a pitch-back selector means.

With such addition of the tilt/pitch changeover means, etc., three working postures, i.e., the digging posture, the earth-moving posture, and the earth-dumping posture, are optionally selectable so that an operator can easily select the desired working posture during the operation in accordance with combined control of the tilt/pitch changeover means, etc. To describe it in more detail, when only the blade control means is operated, the digging posture (lift+tilt) is selected by the lift and tilt operations of the blade. When the tilt/pitch changeover means is turned ON and a control lever is inclined leftwardly and forwardly from the above condition, the earth-moving posture (lift+pitch-back) is selected. Also, when the pitch speed changeover means is turned ON and the control lever is inclined rightwardly and rearwardly, the earth-dumping posture (lift+pitch-dump) is selected. By so optionally selecting the desired posture, any work of digging, earth-moving and earth-dumping by the bulldozer can be easily performed. On the other hand, with the addition of the pitch-dump selector means, etc., the blade can be easily changed into the pitch-dump or the pitch-back mode, enabling any work of digging, earth-moving and earth-dumping to be easily performed.

BEST MODE FOR CARRYING OUT THE INVENTION

Preferred embodiments of a blade apparatus and its control method in a bulldozer according to the present invention will be hereinafter described with reference to the accompanying drawings.

Figure 1:
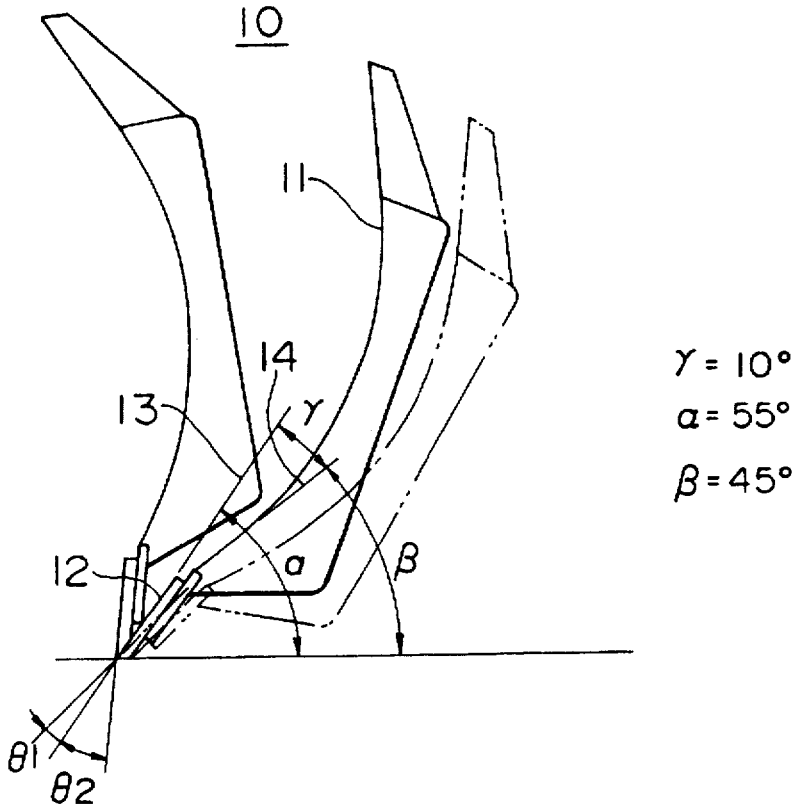
FIG. 1 is an explanatory view of a blade according to the present invention as viewed from the left side.

The first embodiment of the invention concerns a blade control method in a bulldozer and a blade apparatus equipped with an assistant hydraulic pump. FIG. 1 is a left side view of a blade 10 which includes a front panel 11 formed so as to have a curved or concave surface in a vertical plane, with a blade edge member 12 fitted to a lower end of the front panel 11. The blade 10 is formed so that a line 14 tangential to the curved line of the front panel 11 at the lower edge of the front panel 11 is inclined rearwardly at an angle $\gamma$ with respect to the plane 13 of the front face of the blade edge member 12. While $\gamma=10°$ is employed in this embodiment, the angle $\gamma$ can be set to an optimum value, which is less than or equal to 15° depending on the nature of ground, etc. The reason for setting the angle $\gamma$ to be not greater than 15° is that if it exceeds 15°, the amount of earth spilling out of the blade 10 rearwardly would be increased during the digging work.

In FIG. 1, the blade 10 indicated by solid lines on the right side represents a usual digging posture in which the blade edge angle $\alpha$ (angle between the plane 13 of the front face of the blade edge member 12 and a horizontal line) is 55° and the angle $\beta$ (angle between a horizontal line and a line 14 tangent to the lower end of the concave surface of the front panel 12) is 45°. On the other hand, the blade 10 indicated by broken lines represents an earth-moving posture. The rearwardly inclined (pitch-back) angle $\theta_1$ in the earth-moving posture is the angle between the plane 13 of the front face of the blade edge member 12 in the earth-moving posture and the plane 13 of the front face of the blade edge member 12 in the digging work posture. While the rearwardly inclined (pitch-back) angle $\theta_1$ in the earth-moving posture in this illustration is 10°, it can be set to an optimum value in the range of 5° to 20° depending on the nature of ground, etc. The rearwardly inclined angle $\theta_1$ in the earth-moving posture is set in consideration of a limit in the lifting force of a lift hydraulic cylinder and a limit based on the strength of a lower portion of the blade 10.

Further, the blade 10 indicated by solid lines on the left side represents an earth-dumping posture. The forwardly inclined (pitch-dump) angle $\theta_2$ in the earth-dumping posture is the angle between the plane 13 of the front face of the blade edge member 12 in the earth-dumping posture and the plane 13 of the front face of the blade edge member 12 in the digging work posture. While the forwardly inclined (pitch-dump) angle $\theta_2$ of the blade 10 is set to 30° in this illustration corresponding to the nature of ground and work conditions in the ordinary case, it can be set to an optimum value in the range of 5° to 45° depending on the nature of ground, etc. The maximum forwardly inclined angle $\theta_2$ is set to 45° in consideration of a rest angle of the dug earth such that the earth can be dumped even in digging work under the worst conditions where the nature of ground is clayey and the bulldozer is working on a climbable ascending slope. With such an arrangement, an operator can freely control the forwardly inclined angle $\theta_2$ of the blade 10 in accordance with the nature of the ground and the work conditions.

Figure 2:
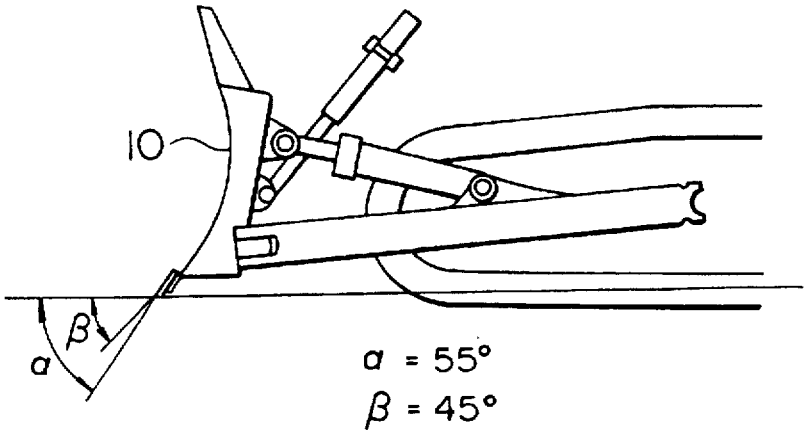
FIG. 2 is an explanatory view of a blade apparatus according to the present invention as viewed from the left side when the apparatus is performing digging work.
Figure 3:
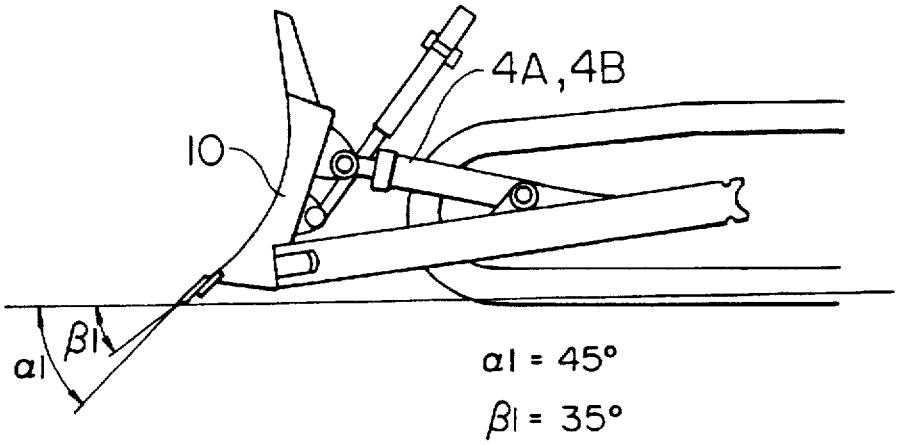
FIG. 3 is an explanatory view of the blade apparatus according to the present invention as viewed from the left side when the apparatus is performing earth-moving work.

A description will now be made of a method of operating the blade 10 constructed as explained above in the sequential work of digging, earth-moving and earth-dumping. The digging work is performed with the blade 10 at an edge angle $\alpha$ of 55° and with the angle $\beta$ between the horizontal ground surface and the line tangential to the lower edge of the curved portion of the front panel 11 being 45°, as shown in FIG. 2. During the earth-moving work, as shown in FIG. 3, a left pitch hydraulic cylinder 4A (hereinafter referred to as a first hydraulic cylinder 4A) and a right pitch hydraulic cylinder 4B (hereinafter referred to as a second hydraulic cylinder 4B), located on the opposite side of the body 2 to the first hydraulic cylinder 4A, are both contracted so that the blade 10 is pitched-back 10° to perform the earth-moving work with the blade edge angle $\beta_1$ being 45° and the angle $\beta$ between the horizontal line and the line tangential to the lower edge of the curved surface of the front panel 11 being 35°.

Figure 6:
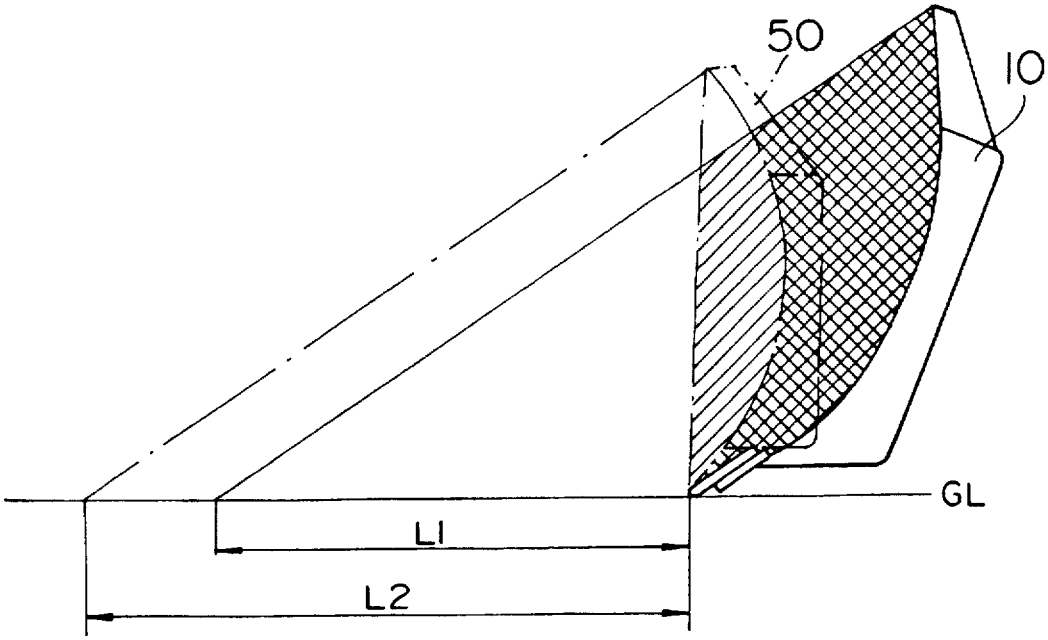
FIG. 6 is an explanatory view of the operation of a blade apparatus according to the present invention when the apparatus is performing earth-moving work.

FIG. 6 shows, for comparison, the prior art blade 50 (indicated by one-dot-chain lines) in the earth-moving posture and the blade 10 of this embodiment in the earth-moving posture. Since the earth-moving work is performed in the prior art while the operator controls the blade 50 so it is pressed downwardly, a front portion of the body of the bulldozer is apt to lift up and the traction force corresponding to the body weight of the bulldozer cannot be achieved in the conventional earth-moving posture. On the other hand, according to this invention, since the blade 10 is inclined rearwardly a predetermined angle $\theta_1$ in the blade's earth-moving posture from the posture of the blade 10 during the digging work, the amount of earth loaded on the blade 10 is increased by an amount corresponding to the cross-hatched portion and a force acts on the blade 10 in such a manner as to cause it to bite into the ground. Therefore, with the present invention the earth-moving work is performed while the operator controls the blade 10 so that it is lifted up, thereby producing a force that acts on the bulldozer body to press its front portion against the ground surface GL. As a result, the ground contact pressure of the crawler belts of the vehicle is distributed substantially uniformly so as to increase the apparent body weight, and hence the traction force is increased.

Figure 17:
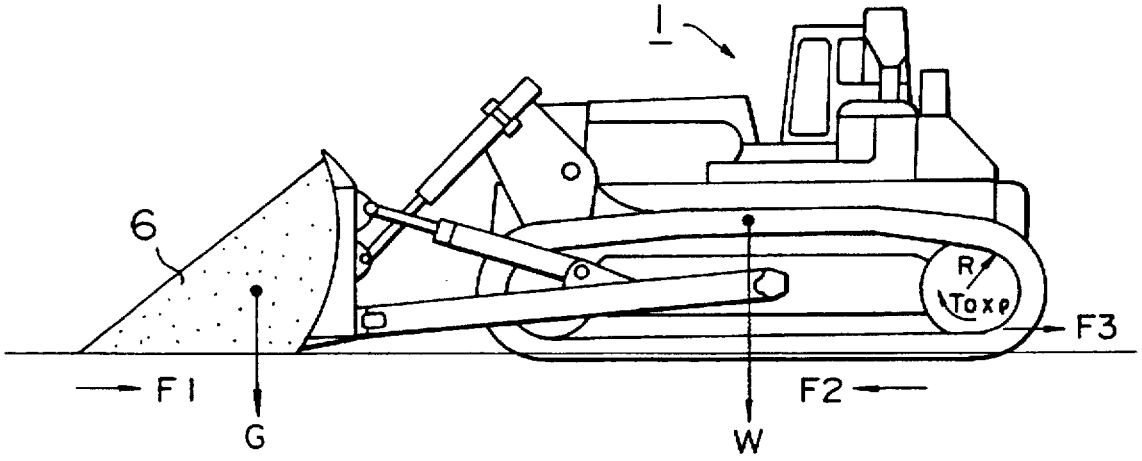
FIG. 17 PRIOR ART
FIG. 17 is a left side view for explaining the general relationship among the traction force, the earth-moving resistance and the vehicle's driving force when the bulldozer is performing earth-moving work.

Further, as shown in FIG. 6, the ground contact length of the earth heaped up in front of the blade 50 in its earth-moving posture is $L_2$ in the prior art, but the ground contact length of the earth heaped up in front of the blade 10 in its earth-moving posture is reduced to $L_1$ in this embodiment. This reduces the weight G (see FIG. 17) of the heaped up earth and diminishes the earth pushing resistance $F_1$. With this embodiment, therefore, the amount of earth comparable to that carryable by a large size bulldozer can be carried by using a bulldozer having a comparatively lighter body weight and the engine output is relatively small as compared with that of the prior art bulldozer.

Figure 4:
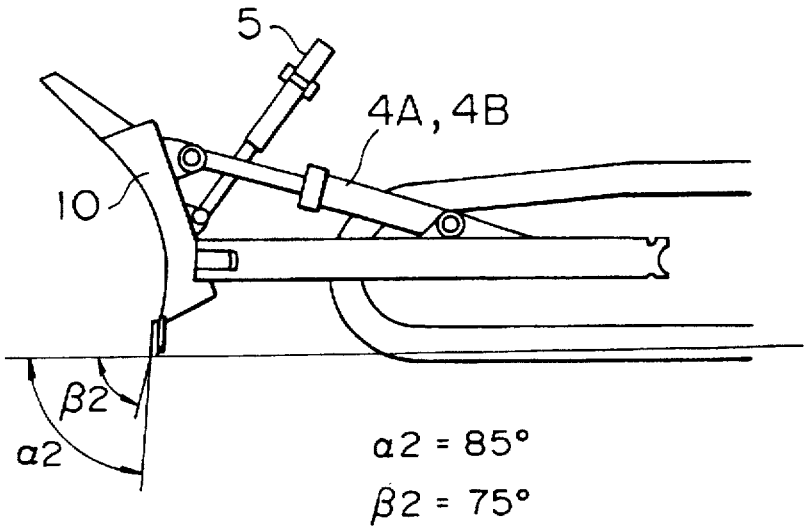
FIG. 4 is an explanatory view of the left side of a blade apparatus according to the present invention when the apparatus is in a maximally pitched-dump state.
Figure 5:
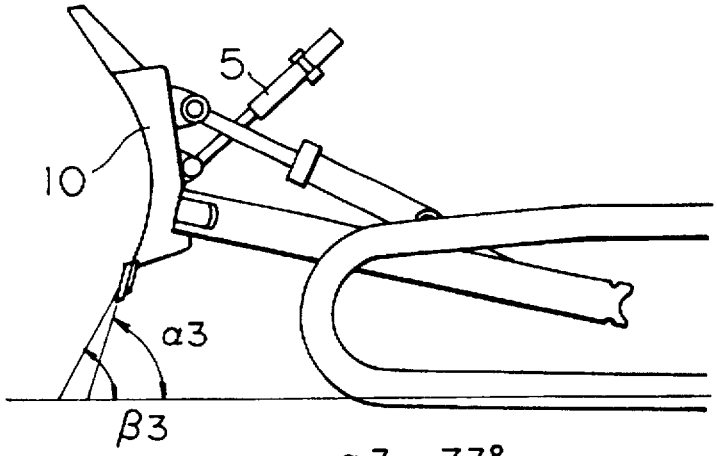
FIG. 5 is an explanatory view of the blade apparatus according to the present invention as viewed from the left side when the apparatus is performing earth-dumping work.

Then, in the earth-dumping work, the first hydraulic cylinder 4A and the second hydraulic cylinder 4B are both extended, as shown in FIG. 4, to pitch-dump the blade 10 by 30° ($\theta_2$) such that the blade edge angle $\alpha_2$ is 85° and the angle $\beta_2$ between the horizontal line and the line tangential to the lower end of the curved front panel 11 is 75°. At this time, to completely dump the earth forwardly, the blade 10 is pitched-dump while advancing the vehicle and, simultaneously, the lift hydraulic cylinder 5 is contracted to raise the blade 10. FIG. 5 shows a state where the blade 10 is pitched-dump 30° and the lift hydraulic cylinder 5 is contracted to the shortest stroke to maximally raise the blade 10. In this state, the blade edge angle $\alpha_3$ is 73°, the angle $\beta_3$ between the horizontal line and the line tangential to the lower edge of the curved front panel 11 is 63°, and the earth is completely dumped from the blade 10.

For an ascending slope with an incline of 20°, by way of example, the blade edge angle $\alpha$ is 53° and the angle $\beta$ between the horizontal line and the line tangential to the lower end of the curved front panel 11 is 43°. This means that the earth can be surely dumped from the blade 10 even on such an ascending slope if the nature of ground is normal. To ensure satisfactory earth dumping on an ascending slope for clayey or like nature ground, the forwardly inclined (pitch-dump) angle $\theta_2$ of the blade is required to be 45°, and this pitch-dump angle can be achieved.

With this embodiment, as described above in detail, since the large pitch-back angle $\theta_1$ is set during the earth-moving work and the large pitch-dump angle $\theta_2$ is set during the earth-dumping work, the amount of earth which can be loaded on the blade 10 is greatly increased. In addition, the traction force is increased, the earth pushing resistance is reduced, and the earth is more satisfactorily dumped by the blade 10. As a result, without greatly increasing the body weight, the engine output, etc. as compared with the prior art bulldozer, the amount of earthwork can be greatly increased with a lighter vehicle. It is thus possible to overcome the technical and economic problems in the prior art and to easily provide a bulldozer having a capability exceeding that of the largest one in the existing series. Incidentally, the present invention is also applicable to any types of construction machines ranging from small size to large size, including bulldozers.

Figure 7:
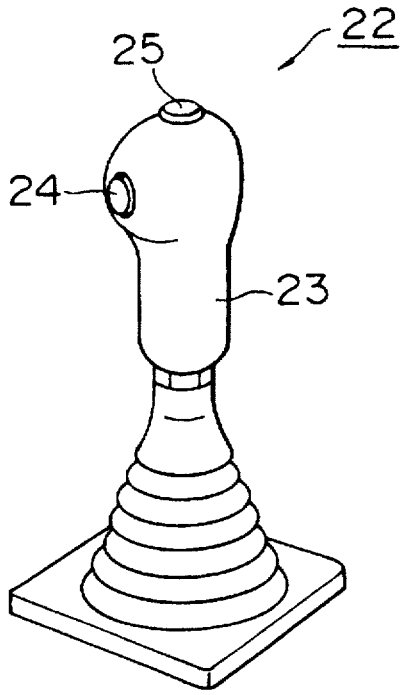
FIG. 7 is a perspective view of a control lever according to the present invention.

FIG. 7 is a perspective view of a control lever 22. A knob 23 of the control lever 22 is provided with a tilt/pitch changeover switch 24 for changing over from a tilt mode to a pitch mode or vice versa, and a pitch speed changeover switch 25.

Figure 8:
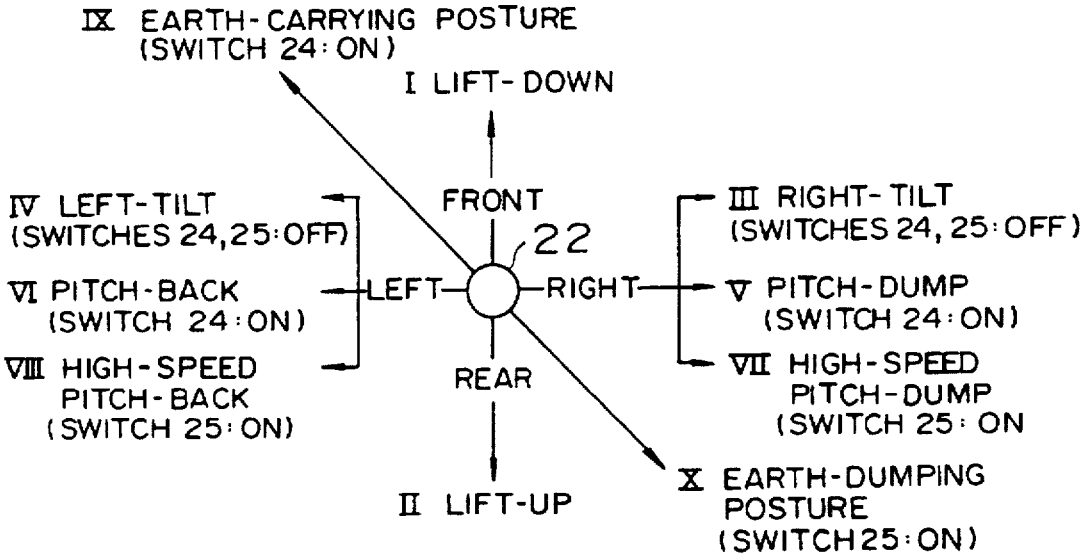
FIG. 8 is an explanatory view of the shift positions of the control lever according to the present invention.

FIG. 8 is an explanatory view showing the relationship between the shift positions of the control lever 22 and the operation of the blade 10. When the control lever 22 is operated under a condition where the tilt/pitch changeover switch 24 (hereinafter referred to as the changeover switch 24) and the pitch speed changeover switch 25 (hereinafter referred to as the speed switch 25) are both turned OFF: the blade 10 is tilted in the right-hand direction if the control lever 22 is inclined rightwardly, is tilted in the left-hand direction if the control lever 22 is inclined leftwardly, is raised if the control lever 22 is inclined rearwardly, and is lowered if the control lever 22 is inclined forwardly.

When the control lever 22 is operated with the changeover switch 24 held ON: the blade 10 is pitched-dump if the control lever 22 is inclined rightwardly; the blade 10 is pitched-back if the control lever 22 is inclined leftwardly; and the blade 10 is lowered while pitching-back, thus coming into the earth-moving posture, if the control lever 22 is inclined obliquely between the forward direction and the leftward direction. Further, when the control lever 22 is operated with the speed switch 25 held ON: the blade 10 is pitched-dump at a high speed if the control lever 22 is inclined rightwardly; the blade 10 is pitched-back at a high speed if the control lever 22 is inclined leftwardly; and the blade 10 is raised while pitching-dump at a high speed, thus coming into the earth-dumping posture, if the control lever 22 is inclined obliquely between the rightward direction and the rearward direction.

Thus, since any of three working postures, i.e., the digging posture, the earth-moving posture and the earth-dumping posture, can be selected in accordance with a combination of the position of the control lever 22 and the positions of the two changeover switches, the operator can vary the working posture during the operation, depending on differences in the nature of ground during the operation, and hence the working efficiency can be improved.

For the blade 10 of this embodiment, as described above, the pitch angle varies through a range of 40° from the maximally pitched-back state to the maximally pitched-dump state. As the pitch range of the blade in the prior art is ±5°, as mentioned before, i.e., the pitch angle varies through a range of 10°, the pitch range of the blade in this invention is much greater than the pitch range of the conventional blade. This leads to a problem in that the cycle time from the earth-moving posture, where the blade is pitched-back to the maximum stroke, to the earth-dumping posture, where the blade is pitched-dump to the maximum stroke, is prolonged.

In order to solve the above problem, the present invention provides the hydraulic drive system described below.

Figure 9:
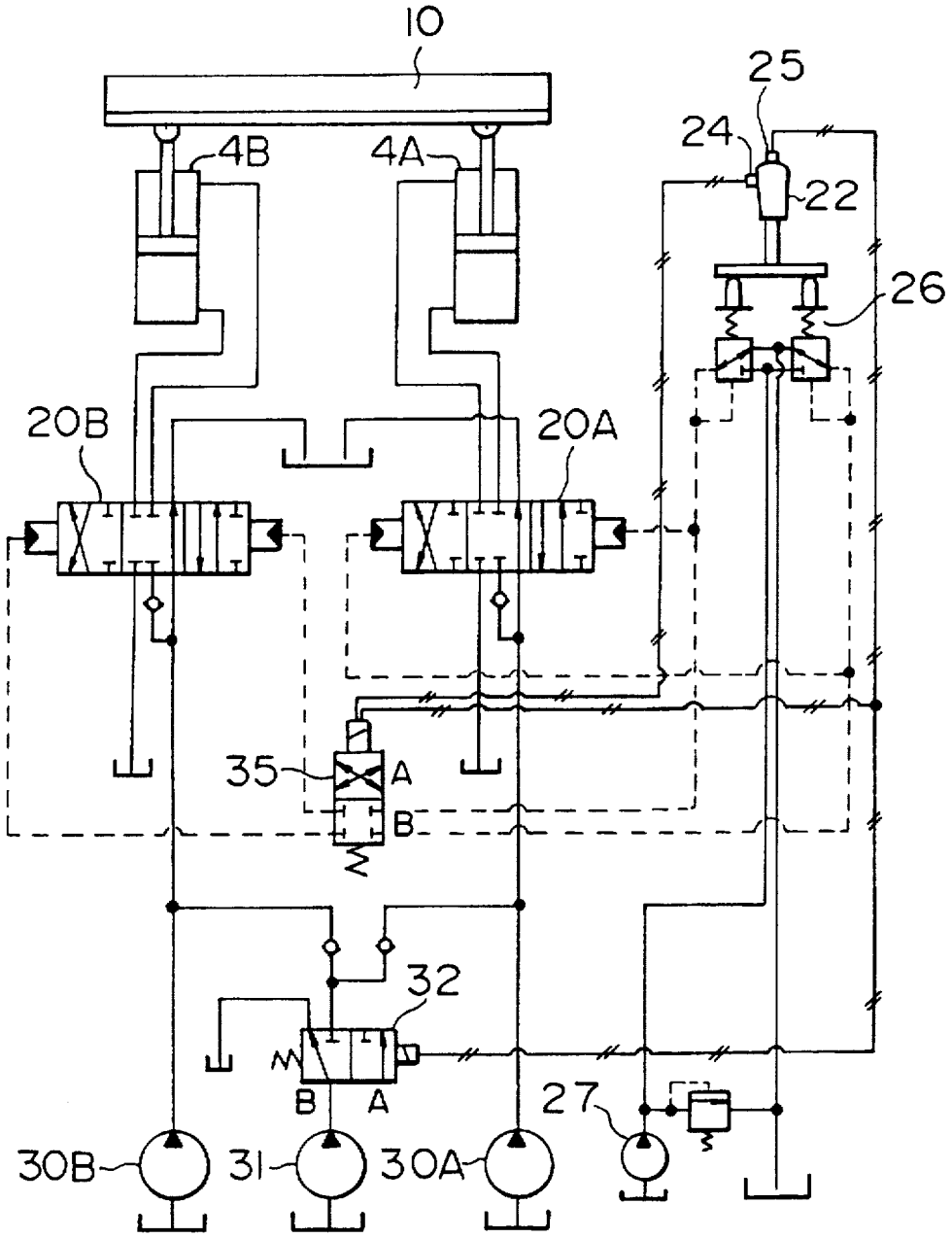
FIG. 9 is a circuit diagram of a hydraulic drive system of a first embodiment according to the present invention.

FIG. 9 shows a hydraulic circuit for the hydraulic drive system of this embodiment. Note that the illustrated circuit diagram represents only the pitch mode circuit, as the lift mode circuit can be the same as in the prior art and is omitted from FIG. 9. Each of the hydraulic pumps 30A and 30B is a fixed displacement hydraulic pump, while pump 31 is an assistant hydraulic pump. The hydraulic pump 30A is connectable to the first hydraulic cylinder 4A through the first directional control valve 20A, while the hydraulic pump 30B is connectable to the second hydraulic cylinder 4B through the second directional control valve 20B. A delivery circuit of the assistant hydraulic pump 31 is connectable to the delivery circuits of the hydraulic pumps 30A and 30B through an assistant solenoid valve 32. The speed switch 25 is connected to the assistant solenoid valve 32 to selectively open or close the assistant circuit. When the assistant solenoid valve 32 is held in a closed position B, the pressurized hydraulic fluid from the assistant hydraulic pump 31 is passed to a drain tank. A pilot pressure control valve 26, actuatable by the movement of the control lever 22, is connected directly to a control port of the first directional control valve 20A and is connectable through a solenoid selector valve 35 to a control port of the second directional control valve 20B. The solenoid of the solenoid selector valve 35 is connected to the changeover switch 24 and to the speed switch 25, both being provided on the control lever 22.

The hydraulic circuit arranged as described above operates as follows. When the control lever 22 is operated to the right or left, the first directional control valve 20A is shifted to contract or extend the first hydraulic cylinder 4A, thereby tilting the blade 10 in the right-hand or left-hand direction. Then, by turning the changeover switch 24 ON, the solenoid selector valve 35 is shifted to its open position A. When the control lever 22 is operated to the right or left with the solenoid selector valve 35 held in the open position A, the first and second directional control valves 20A, 20B are both shifted to simultaneously operate the first and second hydraulic cylinders 4A, 4B in the same direction so that the blade 10 is pitched-back (inclined rearwardly) or pitched-dump (inclined forwardly).

Further, by turning the speed switch 25 ON, the assistant solenoid valve 32 is also shifted to its open position A, with the solenoid selector valve 35 being kept in its open position A. This allows the delivery line of the assistant hydraulic pump 31 to be joined with the delivery lines of the hydraulic pumps 30A and 30B to thereby increase the delivery rates of hydraulic fluid, whereby the blade 10 is pitched-back (inclined rearwardly) or pitched-dump (inclined forwardly) at a high speed. While the illustrated circuit employs two main hydraulic pumps 30A, 30B and one assistant hydraulic pump 31, the circuit can be arranged so as to supply the first and second hydraulic cylinders 4A, 4B with hydraulic fluids from one main hydraulic pump and one assistant hydraulic pump. In this modified case, the circuit is arranged such that when the blade 10 is pitched-back or pitched-dump at a high speed, the delivery rate of the assistant hydraulic pump is added to the delivery rate of the main hydraulic pump.

When the control lever 22 is inclined obliquely between the forward and leftward directions with the changeover switch 24 held ON, the blade 10 is lowered while pitching-back, thus coming into the earth-moving posture. Also, when the control lever 22 is inclined obliquely between the rightward and rearward directions with the speed switch 25 held ON, the blade 10 is raised while pitching-dump at a high speed, thus coming into the earth-dumping posture.

Figure 10:
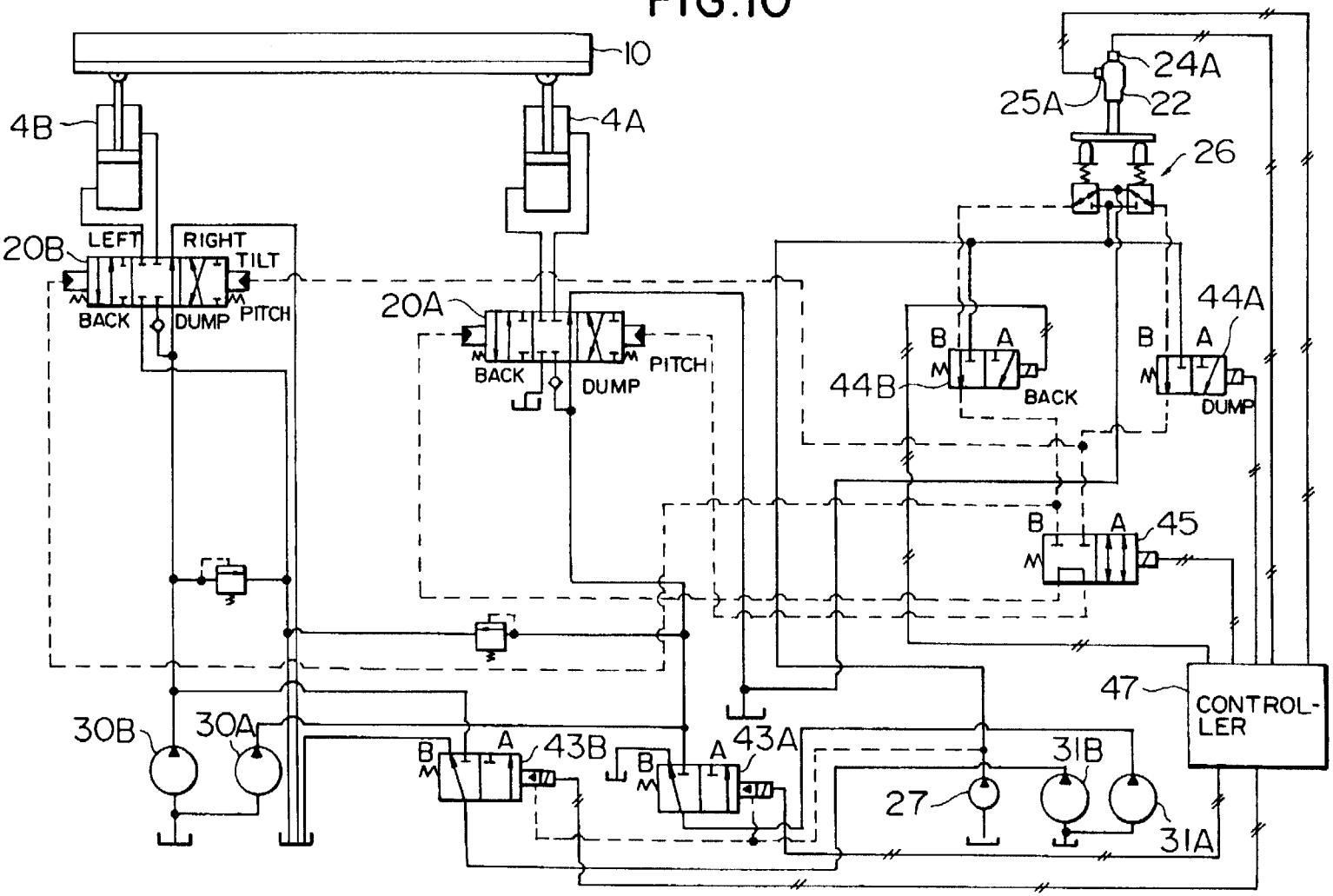
FIG. 10 is a circuit diagram of an alternative hydraulic drive system for the first embodiment.
Figure 11:
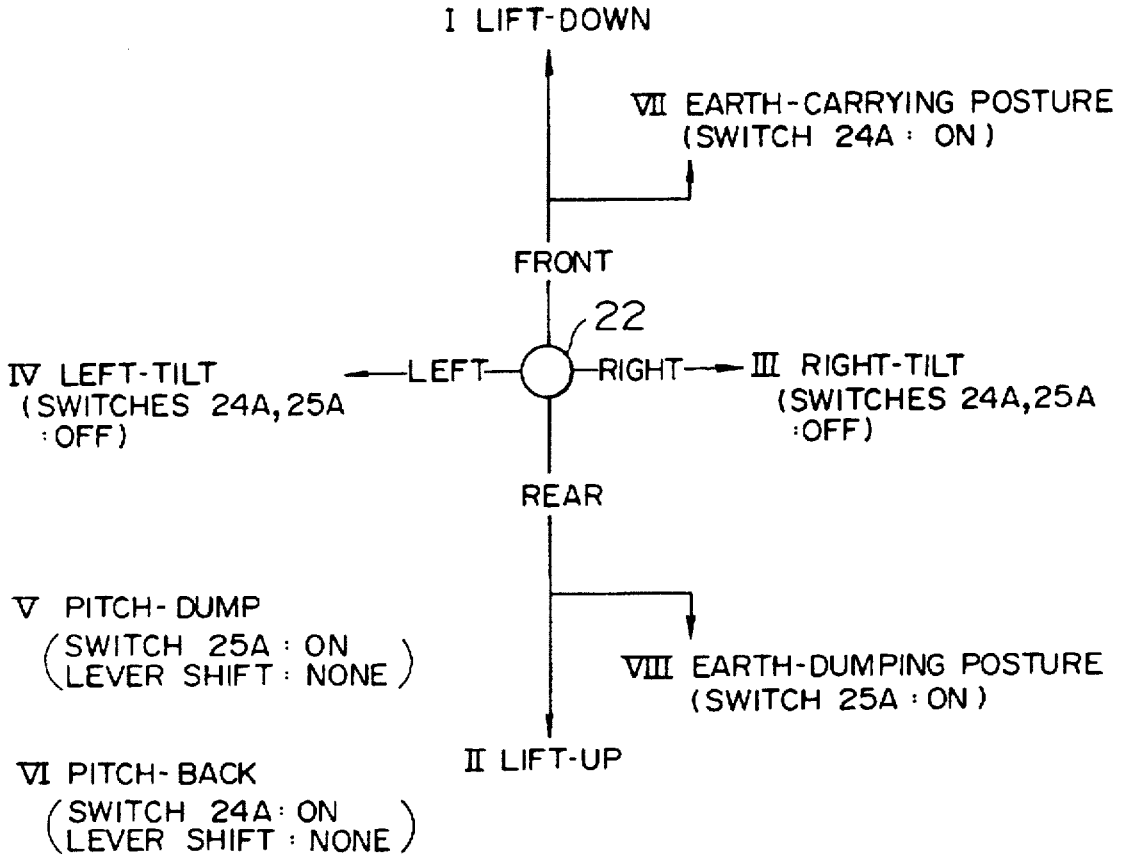
FIG. 11 is an explanatory view for the shift positions of the control lever in FIG. 10.

While the hydraulic drive system includes one assistant hydraulic pump in the above embodiment, a modification including a plurality of, e.g., two, assistant hydraulic pumps will now be described. Also, in this modification, a pitch-dump selector switch and a pitch-back selector switch are provided instead of the tilt/pitch changeover switch 24 and the pitch speed changeover switch 25. FIG. 10 shows this modified hydraulic circuit, and FIG. 11 shows the shift positions of the control lever 22. Note that the lift mode circuit can be the same as in the prior art and is not described here.

The fixed displacement hydraulic pump 30A is connectable to the first hydraulic cylinder 4A through the first directional control valve 20A, while the fixed displacement hydraulic pump 30B is connectable to the second hydraulic cylinder 4B through the second directional control valve 20B. Pumps 31A, 31B are assistant hydraulic pumps. A delivery circuit of the assistant hydraulic pump 31A is connectable to the delivery circuit of the hydraulic pump 30A through an assistant solenoid selector valve 43A. Also, the delivery circuit of the assistant hydraulic pump 31B is connectable to the delivery circuit of the hydraulic pump 30B through an assistant solenoid selector valve 43B.

A pitch-dump selector switch 25A and a pitch-back selector switch 24A are both mounted on control lever 22 and are connected to a controller 47. Output signals of the controller 47 are applied to the assistant solenoid selector valves 43A, 43B, a pitch-dump control valve 44A, a pitch-back control valve 44B, and a solenoid selector valve 45 for changing over between pitch and tilt modes, the valves 44A, 44B and 45 being described below.

A delivery circuit of a pilot hydraulic pump 27 is connected to the hydraulic input of the pilot pressure control valve 26 for the control lever 22. The two hydraulic outputs of the pilot pressure control valve 26 are directly connected to the input ports of the pitch-dump control valve 44A and the pitch-back control valve 44B, respectively, with the output ports of the pitch-dump control valve 44A and the pitch-back control valve 44B being connectable through the solenoid selector valve 45 to opposing control ports of the first directional control valve 20A. One of the output ports of the pilot pressure control valve 26 is also connectable through the pitch-dump control valve 44A to one control port of the second directional control valve 20B, while the other output port of the pilot pressure control valve 26 is connectable through the pitch-back control valve 44B to the opposing control port of the second directional control valve 20B.

The hydraulic circuit arranged as described above operates as follows. When the control lever 22 is operated to the right or left (see FIG. 11), the second directional control valve 20A is shifted to contract or extend the second hydraulic cylinder 4B, thereby tilting the blade 10 in the right-hand or left-hand direction.

Then, by turning ON the pitch-back selector switch 24A, provided on the control lever 22, the controller 47 outputs command signals to shift the pitch-back control valve 44B to its position A, to shift the solenoid selector valve 45 to its position A, and to shift the assistant solenoid selector valves 43A, 43B to their respective positions A. Upon this switching operation, hydraulic fluids delivered from the assistant hydraulic pumps 31A, 31B are joined respectively into the delivery lines of the hydraulic pumps 30A, 30B. At this time, the pilot pressure from the pilot hydraulic pump 27 is introduced through the pitch-back control valve 44B directly to a first control port of the second directional control valve 20B, and is introduced through the pitch-back control valve 44B and the solenoid selector valve 45 to a first control port of the first directional control valve 20A so as to shift the first directional control valve 20A and the second directional control valve 20B. Upon the shifting of the first and second directional control valves 20A, 20B, the first and second hydraulic cylinders 4A, 4B are operated simultaneously in the same direction so that the blade 10 is quickly pitched-back (inclined rearwardly).

Also, by turning ON the pitch-dump selector switch 25A, provided on the control lever 22, the controller 47 outputs command signals to shift the pitch-dump control valve 44A, the solenoid selector valve 45 and the assistant solenoid selector valves 43A, 43B to their respective positions A. Upon this switching operation, hydraulic fluids delivered from the assistant hydraulic pumps 31A, 31B are joined respectively into the delivery lines of the hydraulic pumps 30A, 30B. At this time, the pilot pressure from the pilot hydraulic pump 27 is introduced through the pitch-dump control valve 44A to the second control port of the second directional control valve 4B, and is introduced through the pitch-dump control valve 44A and the solenoid selector valve 45 to the second control port of the first directional control valve 20A, so as to shift the first directional control valve 20A and the second directional control valve 20B. Upon the shifting of the first and second directional control valves 20A, 20B, the joined hydraulic fluids flow into the first and second hydraulic cylinders 4A, 4B to simultaneously operate both of the hydraulic cylinders 4A, 4B in the same direction so that the blade 10 is quickly pitched-dump (inclined forwardly).

Further, by operating the control lever 22 upwardly or downwardly with the pitch-back selector switch 24A and the pitch-dump selector switch 25A held OFF, the blade 10 is raised or lowered in the same manner as in the prior art.

With this modified embodiment, as described above, since the digging work and the earth-moving work are performed by using only the main hydraulic pump(s) and the earth-dumping work is performed by using the main hydraulic pumps and the assistant hydraulic pump in a combined manner, sequential work of digging, earth-moving and earth-dumping can be quickly achieved. Additionally, since the assistant hydraulic pumps are brought into operation only when needed, the power loss can be reduced.

Figure 12:
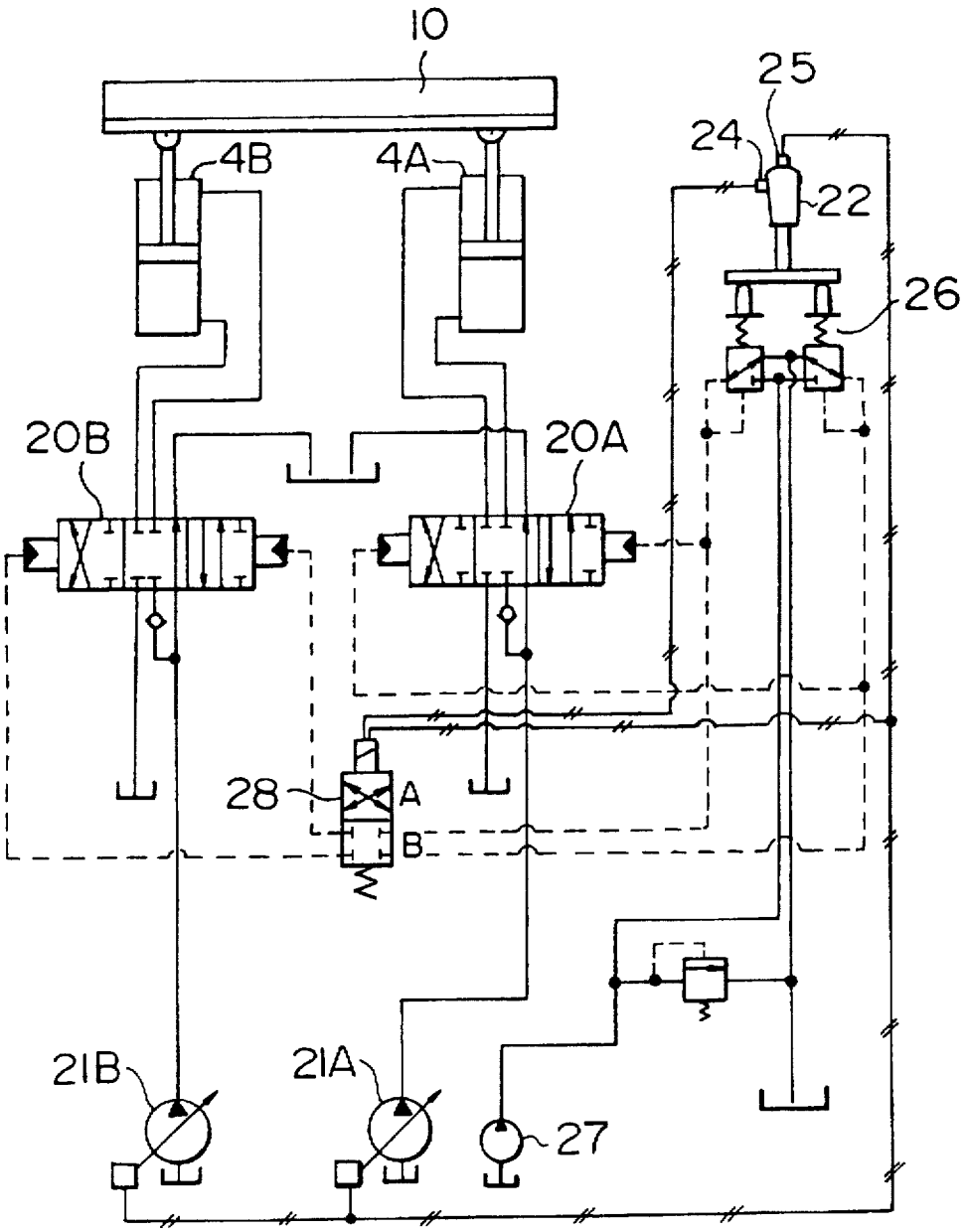
FIG. 12 is a circuit diagram of a hydraulic drive system of a second embodiment according to the present invention.

A second embodiment of the present invention will be described below in detail with reference to the drawings. FIG. 12 shows a hydraulic circuit for a hydraulic drive system of this second embodiment. Note that the illustrated circuit diagram represents a pitch mode circuit. As the lift mode circuit can be the same as in the prior art, it is omitted from FIG. 12. The first hydraulic cylinder 4A is connectable to a variable displacement hydraulic pump 21A through the first directional control valve 20A, and the second hydraulic cylinder 4B is connectable to a variable displacement hydraulic pump 21B through the second directional control valve 20B. A hydraulic pump 27 produces pilot hydraulic pressure. The speed switch 25, provided on the control lever 22, is connected to the variable displacement hydraulic pumps 21A, 21B and to the solenoid of a solenoid valve 28. Further, one hydraulic output of pressure control valve 26, which controls a pilot hydraulic pressure, is connected directly to a control port of the first directional control valve 20A, and is connectable through the solenoid selector valve 28 to a control port of the second directional control valve 20B. The solenoid of the solenoid selector valve 28 is also connected to the changeover switch 24.

The operation of the hydraulic circuit arranged as above will now be described with reference to FIG. 12. When the control lever 22 is operated to the right or left, the first directional control valve 20A is shifted to contract or extend the first hydraulic cylinder 4A, thereby tilting the blade 10 in the right-hand or left-hand direction. Then, by turning ON the changeover switch 24, the solenoid selector valve 28 is shifted to its open position A. When the control lever 22 is operated to the right or left with the solenoid selector valve 28 held in the open position A, the first and second directional control valves 20A, 20B are both shifted to simultaneously operate the first and second hydraulic cylinders 4A, 4B in the same direction so that the blade 10 is pitched-back or pitched-dump.

Further, when the control lever 22 is operated to the right or left with the speed switch 25 held ON, the respective delivery rates of the variable displacement hydraulic pumps 21A, 21B are increased. The blade 10 is thereby pitched-back or pitched-dump at a high speed, enabling a reduction in the pitch adjusting time required for the blade 10. While this embodiment has been described as using two variable displacement hydraulic pumps 21A and 21B, the hydraulic circuit can be constituted by using only one variable displacement hydraulic pump. In addition, as with the above embodiment, when the control lever 22 is inclined obliquely between the forward direction and the leftward direction with the changeover switch 24 held ON, the blade 10 is brought into the earth-moving posture. Similarly, when the control lever 22 is inclined obliquely between the rightward direction and the rearward direction with the speed switch 25 held ON, the blade 10 is brought into the earth-dumping posture.

Since the hydraulic drive system for the blade apparatus of this second embodiment utilizes a variable displacement hydraulic pump, the total delivery rate can be reduced to make the power loss smaller in the digging or earth-moving posture, whereas the total delivery rate can be increased to shorten the pitch adjusting time required for the blade 10 in the earth-dumping posture.

Figure 13:
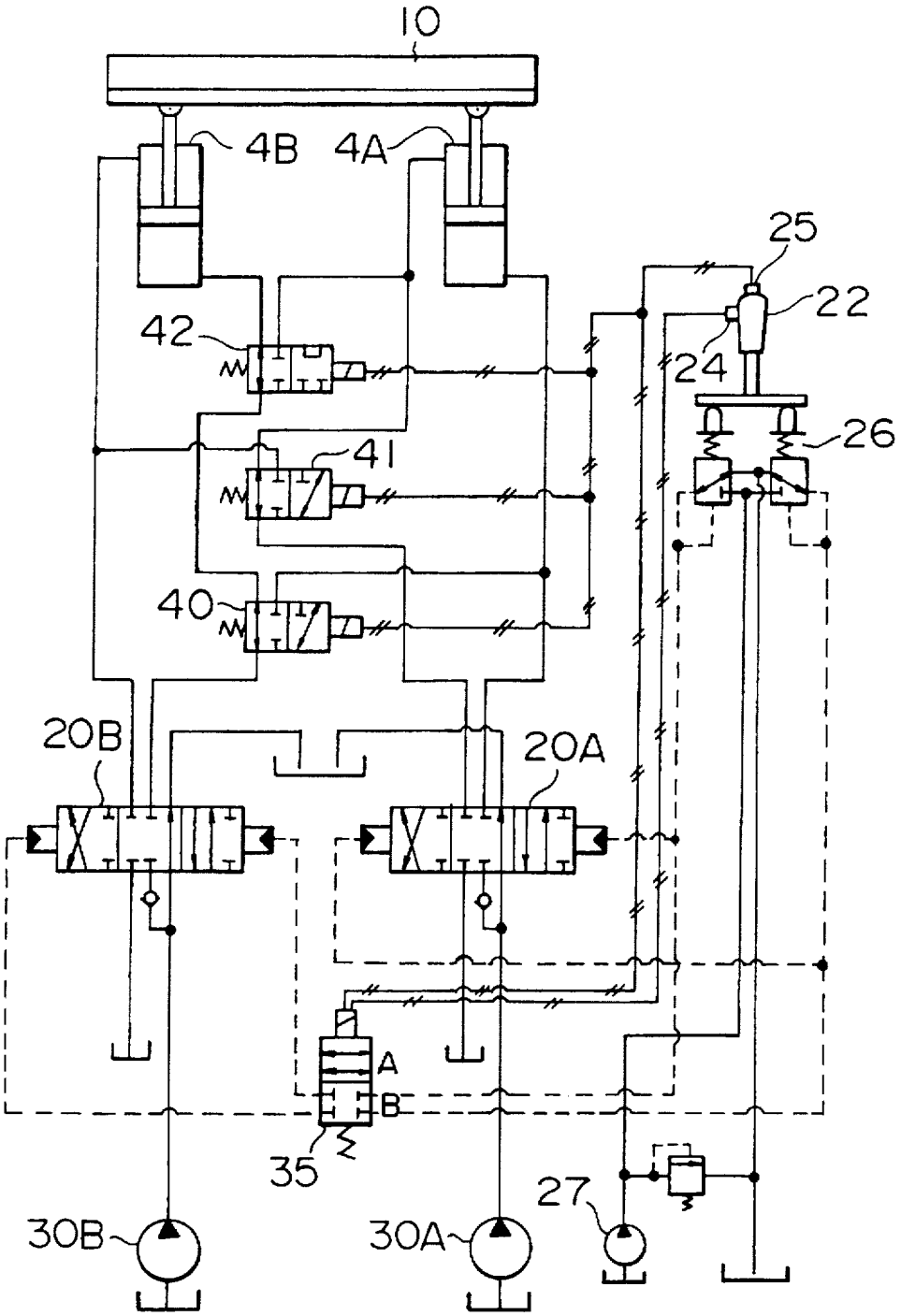
FIG. 13 is a circuit diagram of a hydraulic drive system of a third embodiment according to the present invention.

A blade apparatus in a bulldozer according to a third embodiment of the present invention will be described below. FIG. 13 shows a hydraulic circuit for a hydraulic drive system of this third embodiment. As the lift mode circuit can be the same as in the prior art it is omitted from FIG. 13. First, second and third solenoid selector valves 40, 41, 42 are interposed in lines connecting the first directional control valve 20A and the second directional control valve 20B to the first hydraulic cylinder 4A and the second hydraulic cylinder 4B. The first, second and third solenoid selector valves 40, 41, 42 are illustrated in the drawing as being in an OFF state where hydraulic fluids delivered from the hydraulic pumps 30A, 30B are supplied respectively to the first and second hydraulic cylinders 4A, 4B through the first and second directional control valve 20A, 20B. When the control lever 22 is operated to the right or left, the first directional control valve 20A is shifted to contract or extend the first hydraulic cylinder 4A, thereby tilting the blade 10 in the right-hand or left-hand direction.

The pitch mode operation of the hydraulic circuit arranged as above will now be described with reference to FIG. 13. By turning ON the changeover switch 24, provided on the control lever 22, the solenoid selector valve 35 is shifted to its open position A. When the control lever 22 is operated to the right or left with the solenoid selector valve 35 held in the open position A, the first and second directional control valves 20A, 20B are both shifted to simultaneously operate the first and second hydraulic cylinders 4A, 4B in the same direction so that the blade 10 is pitched-back or pitched-dump.

Further, by turning ON the speed switch 25, provided on the control lever 22, the first, second and third solenoid selector valves 40, 41, 42 are shifted at the same time to form circuits as follows. When the first solenoid selector valve 40 is shifted to ON, the hydraulic fluid delivered from the second hydraulic pump 30B flows through the second directional control valve 20B and the first solenoid selector valve 40 into a delivery line downstream of the first directional control valve 20A where it is joined with the hydraulic fluid delivered from the second hydraulic pump 30A, following which the joined hydraulic fluids flow into a bottom chamber of the first hydraulic cylinder 4A. On the other hand, since the second solenoid selector valve 41 is also shifted to ON, the hydraulic fluid is drained from a head-side line of the second hydraulic cylinder 4B through the second solenoid selector valve 41 into the drain tank. Further, with the third solenoid selector valve 42 shifted to ON, a head-side line of the first hydraulic cylinder 4A is connected to a bottom chamber of the second hydraulic cylinder 4B through the third solenoid selector valve 42, whereupon the first hydraulic cylinder 4A and the second hydraulic cylinder 4B make up a series circuit. While this third embodiment has been described as using two hydraulic pumps, a similar series circuit can be constituted by using only one hydraulic pump.

In addition, as with the above embodiment, when the control lever 22 is inclined obliquely between the forward direction and the leftward direction with the changeover switch 24 held ON, the blade 10 is brought into the earth-moving posture; and when the control lever 22 is inclined obliquely between the rightward direction and the rearward direction with the speed switch 25 held ON, the blade 10 is brought into the earth-dumping posture.

With the blade apparatus of this third embodiment, as described above, the pitch adjusting time required for the blade in the earth-dumping posture can be shortened, since a plurality of solenoid selector switches are interposed to make up a series circuit connecting the head-side of one of two hydraulic cylinders to the bottom-side of the other hydraulic cylinder when the pitch speed changeover switch is turned ON.

Figure 14A:
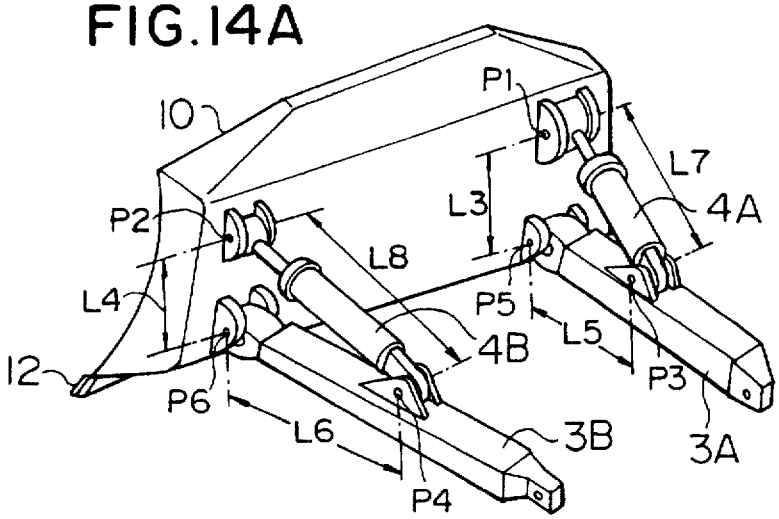
FIG. 14A is a perspective view of a blade apparatus of a fourth embodiment according to the present invention.
Figure 14B:
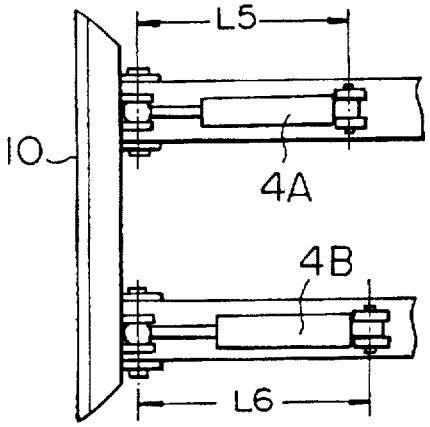
FIG. 14B is an explanatory view of the blade apparatus of the fourth embodiment as viewed from above.
Figure 14C:
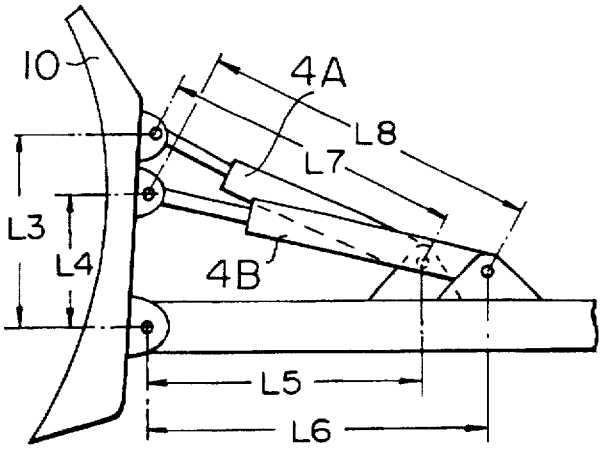
FIG. 14C is an explanatory view of the blade apparatus of the fourth embodiment as viewed from the left side.
Figure 15:
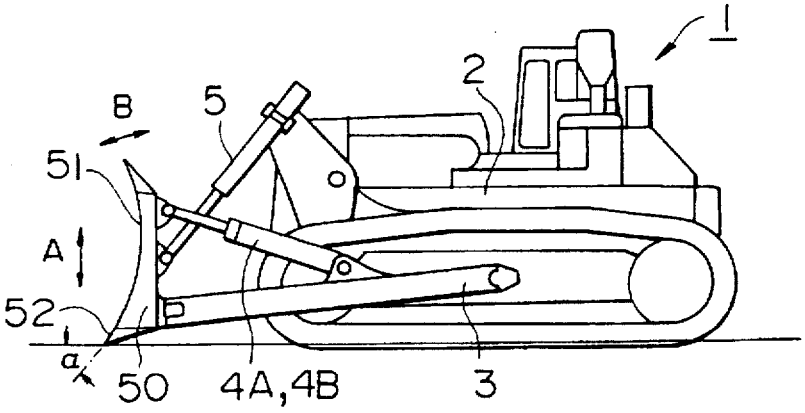
FIG.15 PRIOR ART
FIG. 15 is a left side view of a bulldozer according to the prior art.
Figure 16:
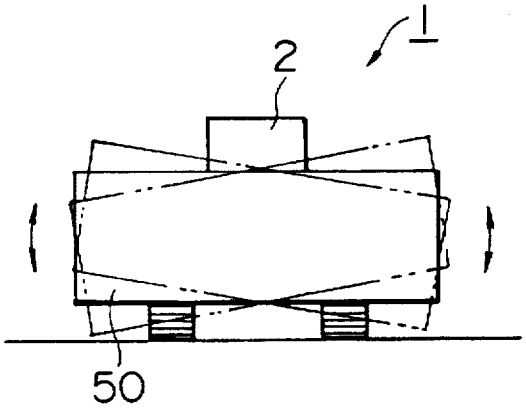
FIG. 16 PRIOR ART
FIG. 16 is an explanatory front view of the blade of the bulldozer according to the prior art.

A fourth embodiment of the present invention will be described below with reference to FIGS. 14A, 14B and 14C. In this embodiment, the first hydraulic cylinder 4A and the second hydraulic cylinder 4B are mounted in asymmetrical positions. The first hydraulic cylinder 4A and the second hydraulic cylinder 4B are pivotally coupled at their distal ends to the blade 10 in respective positions $P_1$, $P_2$, and are pivotably coupled at their rear ends to intermediate portions of the frame members 3A, 3B in respective positions $P_3$, $P_4$. Also, the frame members 3A, 3B are pivotally coupled at their distal ends to the blade 10 in respective positions $P_5$, $P_6$. The first hydraulic cylinder 4A and the second hydraulic cylinder 4B are the same, but the mount positions $P_1$ and $P_2$ of their distal ends on the rear surface of the blade 10 are asymmetrical such that the mount position $P_2$ is lower than the mount position $P_1$. In other words, assuming that the distance between the position $P_1$ and the position $P_5$ is $L_3$ and the distance between the position $P_2$ and the position $P_6$ is $L_4$, the relationship of $L_3>L_4$ holds. Further, assuming that the distance between the position $P_3$ and the position $P_5$ is $L_5$ and the distance between the position $P_4$ and the position $P_6$ is $L_6$, the relationship of $L_5<L_6$ holds. The positions $P_3$ and $P_4$ are also in asymmetrical relation. Thus, when the blade edge member 12 lies horizontally, the relationship of the distance $L_8$ (i.e., the distance between the positions $P_2$ and $P_4$)>the distance $L_7$ (i.e., the distance between the positions $P_1$ and $P_3$).

With the above arrangement, when the first hydraulic cylinder 4A and the second hydraulic cylinder 4B are simultaneously contracted so that the blade 10 is inclined rearwardly (pitched-back), the distance related to the second hydraulic cylinder 4B does not yet reach a minimum at the time the distance $L_7$ related to the first hydraulic cylinder 4A has reached a minimum. In this condition, therefore, the blade 10 can be tilted by further contracting the second hydraulic cylinder 4B. In the prior art, since the first and second hydraulic cylinders are of the same length and are mounted in symmetrical positions, both the hydraulic cylinders come to the stroke ends at the same time when they are contracted simultaneously, meaning that the blade cannot be tilted in the maximally contracted state. The first hydraulic cylinder 4A and the second hydraulic cylinder 4B can be hydraulic cylinders which are different in axial length and/or stroke.

Reasonable variations and modifications are possible within the scope of the foregoing description, the drawings and the appended claims to the invention.

That which is claimed is:

1. An apparatus comprising:

a bulldozer body;

first and second frame members, each of said first and second frame members having a first end and a distal end, with each said first end being pivotally attached to a respective opposite side of said bulldozer body;

a blade pivotally attached to the distal ends of said frame members, said blade having opposite transverse ends;

first and second hydraulic cylinders, each of said first and second hydraulic cylinders pivotally coupling between a respective transverse end of said blade and an intermediate portion of a respective one of said first and second frame members; and a hydraulic drive system for said first and second hydraulic cylinders so that said first and second hydraulic cylinders can be extended or contracted by said hydraulic drive system so that said blade can be tilted in the right-hand or left-hand direction and inclined forwardly or rearwardly;

wherein a thus coupled position of said first hydraulic cylinder to at least one of said blade and the frame member to which the first hydraulic cylinder is coupled and a thus coupled position of said second hydraulic cylinder to a corresponding at least one of said blade and the frame member to which the second hydraulic cylinder is coupled are in asymmetrical relation to each other.

2. An apparatus in accordance with claim 1, wherein an axial length of said first hydraulic cylinder is equal to an axial length of said second hydraulic cylinder.

3. An apparatus in accordance with claim 1, wherein said first hydraulic cylinder and said second hydraulic cylinder differ from each other in at least one of minimum axial length and stroke.

4. An apparatus comprising:

a bulldozer body having a first side and a second side;

a blade having first and second transverse ends;

a first frame member having a first end and a distal end, the first end of the first frame member being pivotally attached to the first side of the bulldozer body, the distal end of the first frame member being pivotally attached to the first transverse end of the blade at a first mount position;

a second frame member having a first end and a distal end, the first end of the second frame member being pivotally attached to the second side of the bulldozer body, the distal end of the second frame member being pivotally attached to the second transverse end of the blade at a second mount position;

a first hydraulic cylinder having a first end and a second end, the first end of the first hydraulic cylinder being pivotally attached to the first transverse end of the blade at a third mount position, the second end of the first hydraulic cylinder being pivotally attached to an intermediate portion of the first frame member at a fourth mount position;

a second hydraulic cylinder having a first end and a second end, the first end of the second hydraulic cylinder being pivotally attached to the second transverse end of the blade at a fifth mount position, the second end of the second hydraulic cylinder being pivotally attached to an intermediate portion of the second frame member at a sixth mount position; and a hydraulic drive system for said first and second hydraulic cylinders so that said first and second hydraulic cylinders can be extended or contracted by said hydraulic drive system so that said blade can be tilted in a right-hand direction or a left-hand direction and can be inclined forwardly or rearwardly;

wherein at least one of the following conditions is present:

(a) said third mount position and said fifth mount position are asymmetrically located on said blade; and (b) said fourth mount position and said sixth mount position are asymmetrically located on said first and second frame members.

5. Apparatus in accordance with claim 4, wherein said third mount position is lower on said blade than said fifth mount position.

6. Apparatus in accordance with claim 4, wherein a distance between the second mount position and the fifth mount position is greater than a distance between the first mount position and the third mount position.

7. Apparatus in accordance with claim 4, wherein a distance between the fourth mount position and the first mount position is greater than a distance between the sixth mount position and the second mount position.

8. Apparatus in accordance with claim 7, wherein a distance between the second mount position and the fifth mount position is greater than a distance between the first mount position and the third mount position.

9. Apparatus in accordance with claim 4, wherein said third mount position and said fifth mount position are asymmetrically located on said blade.

10. Apparatus in accordance with claim 4, wherein said fourth mount position and said sixth mount position are asymmetrically located on said first and second frame members.

11. Apparatus in accordance with claim 4, wherein said third mount position and said fifth mount position are asymmetrically located on said blade such that said third mount position is lower on said blade than said fifth mount position; and wherein said fourth mount position and said sixth mount position are asymmetrically located on said first and second frame members.

12. Apparatus in accordance with claim 11, wherein said blade has a blade edge member; and wherein when the blade edge member lies horizontally, a distance between the third mount position and the fourth mount position is greater than a distance between the fifth mount position and the sixth mount position.

13. Apparatus in accordance with claim 12, wherein said first and second hydraulic cylinders are identical to each other.

14. Apparatus in accordance with claim 12, wherein said first and second hydraulic cylinders differ from each other in at least one of stroke and axial length.

15. Apparatus in accordance with claim 12, wherein when said first and second hydraulic cylinders are simultaneously contracted so that the blade is inclined rearwardly, one of the first and second hydraulic cylinders is not at its minimum length when the other of the first and second hydraulic cylinders reaches its minimum length.

16. Apparatus in accordance with claim 4, wherein said blade has a blade edge member; and wherein when the blade edge member lies horizontally, a distance between the third mount position and the fourth mount position is greater than a distance between the fifth mount position and the sixth mount position.

17. Apparatus in accordance with claim 4, wherein said first and second hydraulic cylinders are identical to each other.

18. Apparatus in accordance with claim 4, wherein said first and second hydraulic cylinders differ from each other in at least one of stroke and axial length.

19. Apparatus in accordance with claim 4, wherein when said first and second hydraulic cylinders are simultaneously contracted so that the blade is inclined rearwardly, one of the first and second hydraulic cylinders is not at its minimum length when the other of the first and second hydraulic cylinders reaches its minimum length.

* * * * *